US007675273B2

(12) United States Patent
Ko et al.

(10) Patent No.: US 7,675,273 B2
(45) Date of Patent: Mar. 9, 2010

(54) WIDEBAND LOW DROPOUT VOLTAGE REGULATOR

(75) Inventors: Jin-Su Ko, San Jose, CA (US); Sunghyun Park, San Jose, CA (US)

(73) Assignee: Qualcomm Incorporated, San Diego, CA (US)

( * ) Notice: Subject to any disclaimer, the term of this patent is extended or adjusted under 35 U.S.C. 154(b) by 140 days.

(21) Appl. No.: 11/864,364

(22) Filed: Sep. 28, 2007

(65) Prior Publication Data

US 2009/0085534 A1 Apr. 2, 2009

(51) Int. Cl.
*G05F 1/59* (2006.01)
*G05F 1/575* (2006.01)

(52) U.S. Cl. ..... 323/269; 323/270

(58) Field of Classification Search ..... 323/226, 323/265, 268, 269, 270, 273, 274, 275, 312, 323/316

See application file for complete search history.

(56) References Cited

U.S. PATENT DOCUMENTS 5,739,681 A * 4/1998 Allman ..... 323/314
7,019,580 B1 * 3/2006 Michalski ..... 327/427
7,190,936 B1 3/2007 Teo et al.
7,224,204 B2 * 5/2007 Walter ..... 327/427

OTHER PUBLICATIONS

Gerrit W. Den Besten et al., "Embedded 5V-to-3.3V Voltage Regulator for Supplying Digital ICs in 3.3V CMOS Technology," IEEE Journal of Solid-State Circuits, vol. 33, No. 7, pp. 956-962, Jul. 1998.

Vishal Gupta et al., "A Low Dropout, CMOS Regulator with High PSR over Wideband Frequencies," ISCAS, vol. 5, pp. 4245-4228, 2000.

Joseph M. Ingino et al., "A 4-GHz Clock System for a High-Performance System-on-a-Chip Design," IEEE Journal of Solid-State Circuits, vol. 36, No. 11, pp. 1693-1698, Nov. 2001.

Chang-Hyeon Lee et al., "A Supply-Noise-Insensitive CMOS PLL With a Voltage Regulator Using DC-DC Capacitive Converter," IEEE Journal of Solid-State Circuits, vol. 36, No. 10, pp. 1453-1463, Oct. 2001.

Maxim, "Selecting LDO Linear Regulators for Cellphone Designs," Maxim, Application Notes, Power-Supply Circuits, Dec. 26, 2001.

Yue Wu et al., "A Monolithic Low Phase Noise 1.7GHz CMOS VCO for Zero-IF Cellular CDMA Receivers," IEEE International Solid-State Circuits Conference, ISSCC, Session 21, RF Potpourri 21.10, Feb. 2004.

* cited by examiner

*Primary Examiner*—Gary L Laxton
(74) *Attorney, Agent, or Firm*—Jiayu Xu

(57) ABSTRACT

A method and apparatus for regulating a supply voltage to an integrated circuit is disclosed. The method and apparatus provides good power supply noise rejection characteristics over a wide bandwidth as well as low dropout voltage. In the disclosed methods and apparatus, native NMOS source followers may be stacked and coupled to a supply rail to supply a regulated voltage to a load. The gates of the native NMOS source followers may be coupled to the outputs of internal regulators. The internal regulators may also contain stacked NMOS source followers. In an embodiment, the internal regulators may be supplied by a high voltage source, while native NMOS source followers may be supplied by a low voltage source. In another embodiment, lo-pass filters may filter the signal from the internal regulators to the NMOS source followers. In yet another embodiment, the gates of the source followers may be coupled to the sources of the transistors with the internal regulators.

43 Claims, 5 Drawing Sheets

WIDEBAND LOW DROPOUT VOLTAGE REGULATOR

TECHNICAL FIELD

The disclosure relates to integrated circuits (IC's), and more specifically, to the design of IC voltage regulators.

BACKGROUND

In modern integrated circuits, voltage regulators provide stable voltage references for on-chip blocks such as digital, analog, and RF. An ideal regulator inputs an unregulated voltage from a voltage source, and provides a constant output voltage substantially free of noise or spurs. A typical regulator uses some type of feedback mechanism to monitor and remove variations in the output voltage.

One figure of merit for a regulator is the power supply noise rejection, or PSNR, defined as the ratio of noise appearing on the input voltage to noise appearing on the output voltage. In conventional closed loop regulation, the PSNR is inversely proportional to the loop bandwidth (LBW) of the feedback mechanism. In such designs, power supply noise lying in frequencies beyond the LBW may be hard to remove. On the other hand, a regulator with a wide LBW may consume a great deal of current.

Another figure of merit for a regulator is the dropout voltage. The dropout voltage is the minimum voltage across the regulator required to maintain the output voltage at the correct level. The lower the dropout voltage, the less supply voltage is required, and the less power is dissipated internally within the regulator.

What is needed is a voltage regulator design that provides good PSNR over a wide bandwidth, along with a low dropout voltage.

SUMMARY

An aspect of the present disclosure provides an apparatus for generating a regulated output voltage from an unregulated voltage, the apparatus comprising a secondary source follower comprising a secondary native NMOS transistor, the secondary source follower having a drain, gate, and source voltage, the drain voltage coupled to the unregulated voltage; a primary source follower comprising a primary native NMOS transistor, the primary source follower having a drain, gate, and source voltage, the drain voltage of the primary source follower coupled to the source voltage of the secondary source follower, the source voltage of the primary source follower being the regulated output voltage; a secondary internal regulator comprising an amplifier and a feedback network, the feedback network comprising a secondary internal native NMOS transistor, the secondary internal regulator configured to regulate a gate-source voltage of the secondary internal native NMOS transistor, an output voltage of the secondary internal regulator comprising the gate or source voltage of the secondary internal native NMOS transistor, the output voltage of the secondary internal regulator coupled to the gate voltage of the secondary source follower; and a primary internal regulator comprising an amplifier and a feedback network, the feedback network comprising a primary internal native NMOS transistor, the primary internal regulator configured to regulate a gate-source voltage of the primary internal native NMOS transistor, an output voltage of the primary internal regulator comprising the gate or source voltage of the primary internal native NMOS transistor, the output voltage of the primary internal regulator coupled to the gate voltage of the primary source follower.

Another aspect of the present disclosure provides an apparatus for generating an output regulated voltage from an unregulated voltage, the apparatus comprising a secondary source follower comprising a secondary native NMOS transistor, the secondary source follower having a drain, gate, and source voltage, the drain voltage coupled to the unregulated voltage; a primary source follower comprising a primary native NMOS transistor, the primary source follower having a drain, gate, and source voltage, the drain voltage of the primary source follower coupled to the source voltage of the secondary source follower, the source voltage of the primary source follower being the output regulated voltage; means for generating a secondary internal regulated voltage coupled to the gate voltage of the secondary source follower; and means for generating a primary internal regulated voltage coupled to the gate voltage of the primary source follower.

Yet another aspect of the present disclosure provides a method for generating a regulated output voltage from an unregulated voltage, the method comprising regulating a gate-source voltage of a secondary internal native NMOS transistor; providing the gate or source voltage of the secondary internal native NMOS transistor to the gate of a secondary source follower, the drain of the secondary source follower coupled to the unregulated voltage; regulating a gate-source voltage of a primary internal native NMOS transistor, the drain of the primary internal native NMOS transistor coupled to the source of the secondary internal native NMOS transistor; and providing the gate or source voltage of the primary internal native NMOS transistor to the gate of a primary source follower, the drain of the primary source follower coupled to the source of the secondary source follower, the source voltage of the primary internal native NMOS transistor being the regulated output voltage.

Yet another aspect of the present disclosure provides an apparatus for generating a regulated output voltage from an unregulated voltage, the apparatus comprising a source follower comprising a native NMOS transistor, the source follower having a drain, gate, and source voltage, the drain voltage coupled to the unregulated voltage, the source voltage of the source follower being the regulated output voltage; and an internal regulator comprising an amplifier and a feedback network, the feedback network comprising an internal native NMOS transistor, the internal regulator configured to regulate a gate-source voltage of the internal native NMOS transistor, an output voltage of the internal regulator comprising the gate or source voltage of the internal native NMOS transistor, the output voltage of the internal regulator coupled to the gate voltage of the source follower.

DETAILED DESCRIPTION

Disclosed herein are techniques for designing a voltage regulator capable of wideband noise rejection and low dropout voltage operation.

Figure 1:
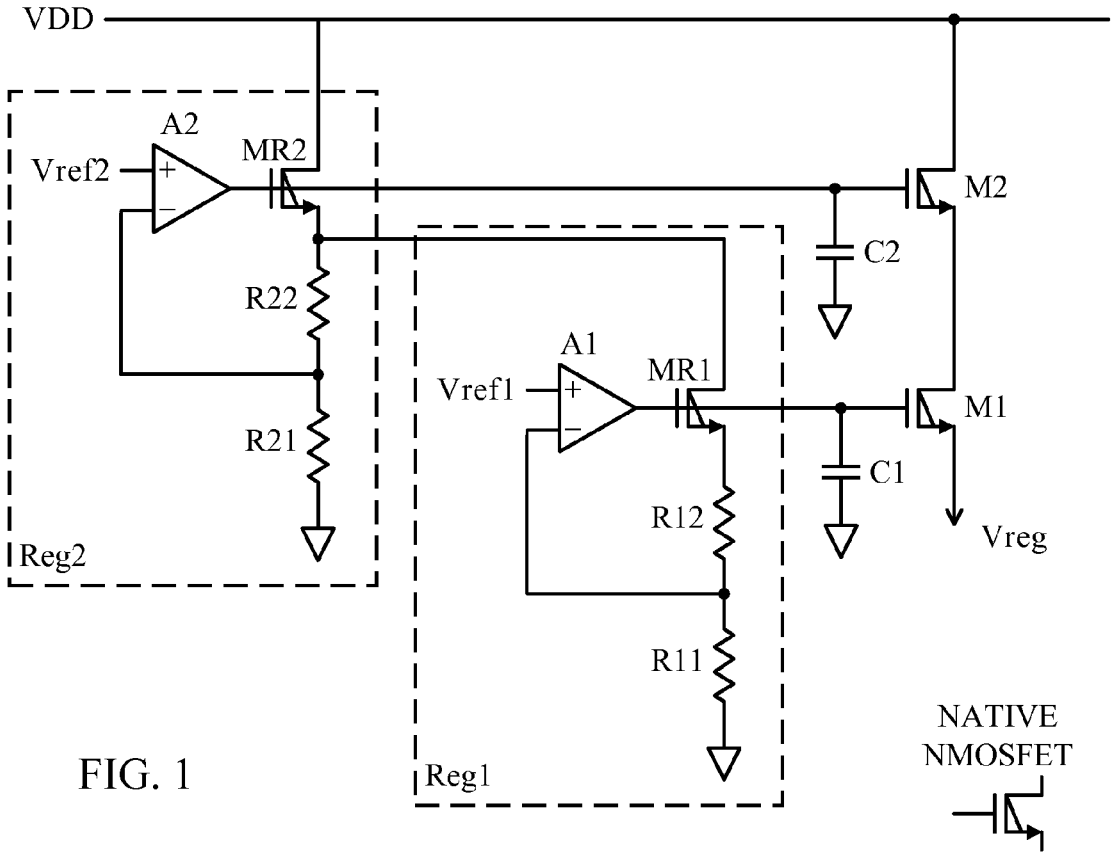
FIG. 1 depicts an embodiment of a regulator according to the present disclosure.

FIG. 1 depicts an embodiment of a regulator according to the present disclosure. Two native NMOS transistors M2 and M1 are stacked to couple the unregulated voltage supply VDD to the regulated output voltage Vreg. Because native NMOS transistors have a threshold voltage close to zero, they may be stacked in series to improve PSNR while maintaining low dropout voltage. Each of M2, M1 is configured as a source follower, with the source voltages of M2, M1 following the gate voltages of M2, M1. The source of M1 is the regulated output voltage Vreg, which may be coupled to a load (not shown).

In FIG. 1, the gates of M2, M1 are coupled to the gates of transistors MR2, MR1. In an embodiment, MR2, MR1 can be replica native NMOS transistors designed to match the characteristics of M2, M1 over layout and process variations. Note MR2, MR1 are also stacked, to match the topology of M2, M1. The gate voltages of M2, M1 are controlled by internal regulators Reg2, Reg1, respectively.

Within internal regulators Reg2, Reg1, negative feedback is applied to amplifiers A2, A1 through resistors R22, R21 and R12, R11 to maintain constant current through MR2, MR1, regardless of fluctuations in VDD. As a result, the gate-source voltages of MR2, MR1, and hence the gate voltages of M2, M1, are kept substantially constant over the LBW of the amplifiers A2, A1. Since M2, M1 are configured as source followers, this mechanism removes variations in VDD within the LBW of the feedback amplifiers from the sources of M2, M1.

Note reference voltages Vref2, Vref1 may be chosen to set the bias current through transistors MR2, MR1.

In FIG. 1, capacitors C2, C1 may be provided to low-pass filter the gate voltages of M2, M1. The low-pass filtering may remove high frequency variations in VDD beyond the LBW of amplifiers A2, A1. In this way, the circuitry in FIG. 1 provides good PSNR over a wide bandwidth.

In an embodiment (not shown), a single native NMOS transistor may be utilized in place of stacked native NMOS transistors. For example, Reg1, C1, and M1 may be omitted from the schematic of FIG. 1, and the output voltage Vreg of the regulator taken to be the source voltage of M2.

Figure 2:
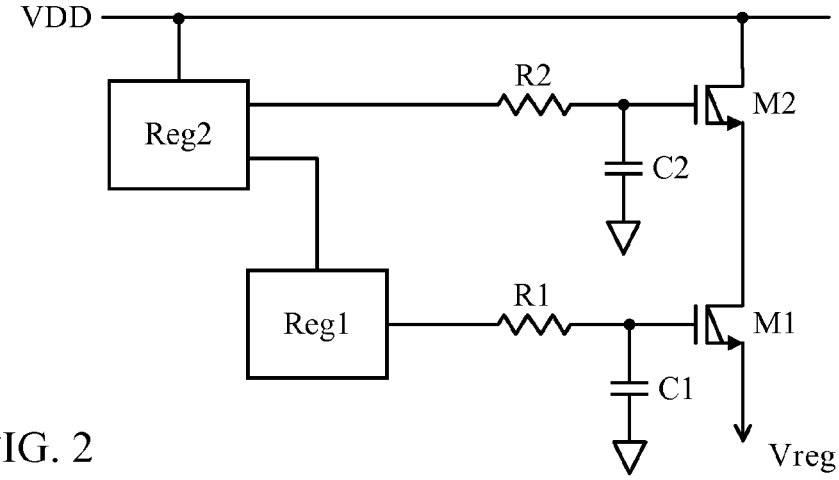
FIG. 2 depicts an embodiment wherein resistors R2 and R1 are added to low-pass filter the gate voltages of M2 and M1, respectively.

FIG. 2 depicts an embodiment wherein resistors R2 and R1 are added to further low-pass filter the gate voltages of M2 and M1, respectively. The resistors effectively lower the pole frequency to increase the rejection of high frequency variations in VDD beyond the internal regulators' LBW. This may provide additional rejection of 1/f noise arising from the transistors in the regulator. In an embodiment, the resistors can be chosen to set the pole of each low-pass filter at 1 kHz.

In an embodiment, a design may incorporate only R1 without R2. In another embodiment, a design may incorporate only R2 without R1. In an embodiment, to reduce area, any or all of R1, R2, C1, and C2 may be implemented as MOSFETs, using techniques well-known in the art.

Figure 3:
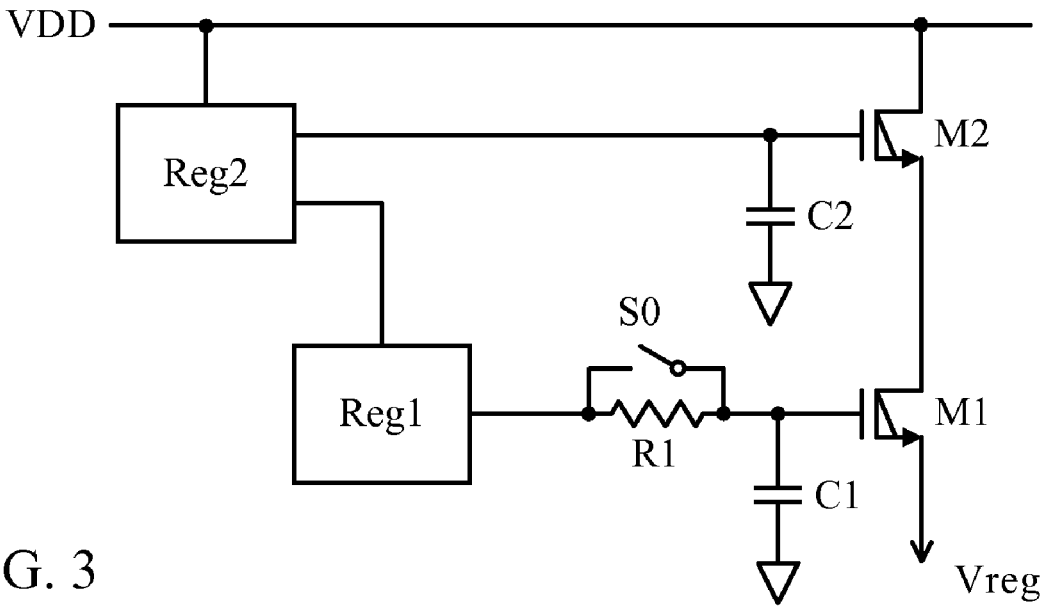
FIG. 3 depicts an embodiment wherein a switch S0 is added in parallel with the resistor R1.

FIG. 3 depicts an embodiment wherein a switch S0 is added in parallel with the resistor R1. Switch S0 may be selectively closed to speed up the charging of capacitor C1, for example, during initial power-up of the regulator. During normal operation, S0 may be opened to reintroduce the resistor R1.

In an embodiment, a similar switch may be added in parallel with resistor R2 (not shown in FIG. 3).

Figure 4:
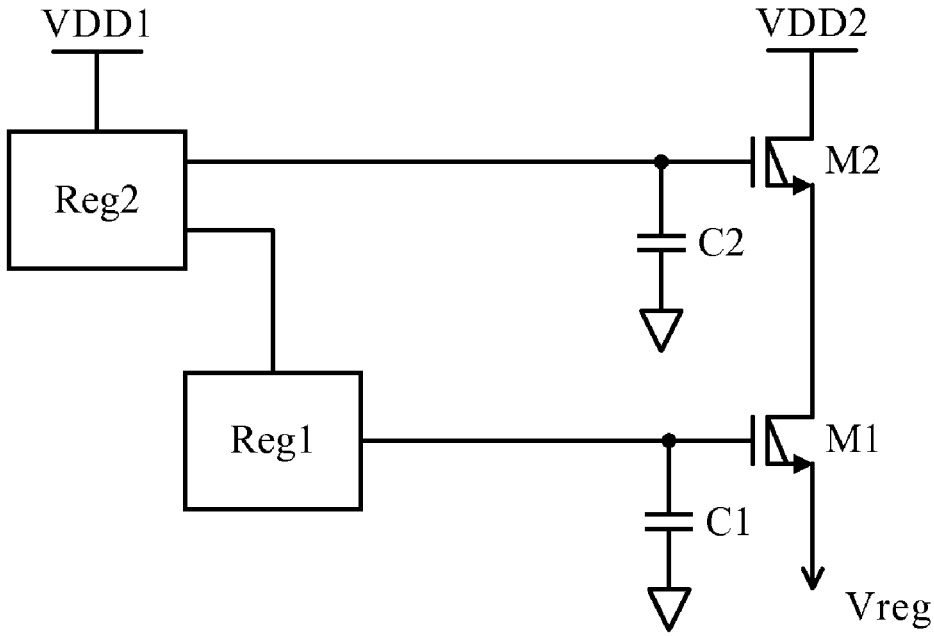
FIG. 4 depicts an embodiment wherein Reg2, Reg1 are coupled to a different voltage source VDD1 than the voltage source VDD2 coupled to M2, M1.

FIG. 4 depicts an embodiment wherein Reg2 is coupled to a different voltage source VDD1 than the voltage source VDD2 coupled to M2. In an embodiment, VDD1 can be higher than VDD2, so that the voltage supplying the internal regulators Reg2, Reg1 is higher than the voltage supplying M2, M1 and the load. A higher supply voltage for the internal regulators may allow the internal regulators to provide higher PSNR, while a lower supply voltage for the load is desirable for low-voltage operation.

In an embodiment, to accommodate the higher supply voltage, the native transistors MR2, MR1 may be thick oxide devices, while the native transistors M2, M1 may be thin oxide devices.

Figure 5:
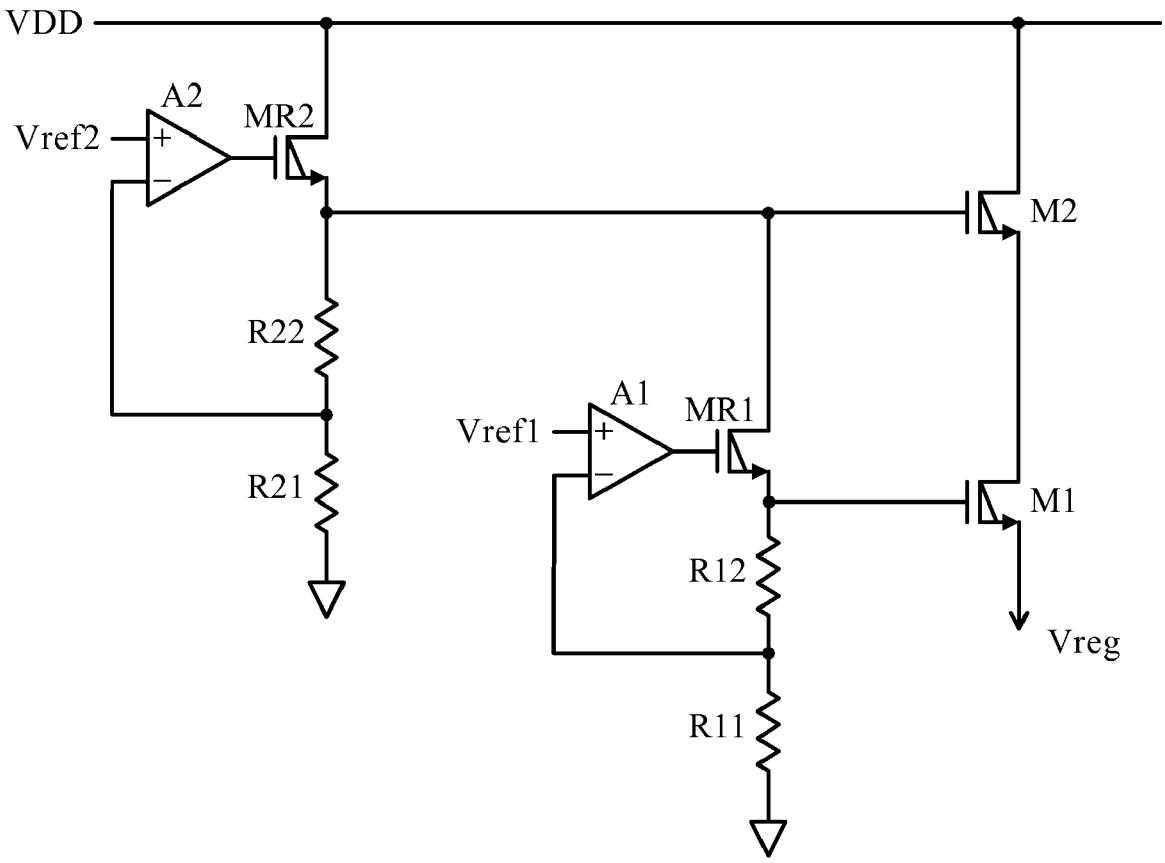
FIG. 5 depicts an embodiment wherein the gates of M2, M1 are coupled to the sources of MR2, MR1, rather than the gates of MR2, MR1 as depicted in FIG. 1.

FIG. 5 depicts an embodiment wherein the gates of M2, M1 are coupled to the sources of MR2, MR1, rather than the gates of MR2, MR1 as depicted in FIG. 1. In some cases, this embodiment may yield a more stable Vreg.

Figure 6:
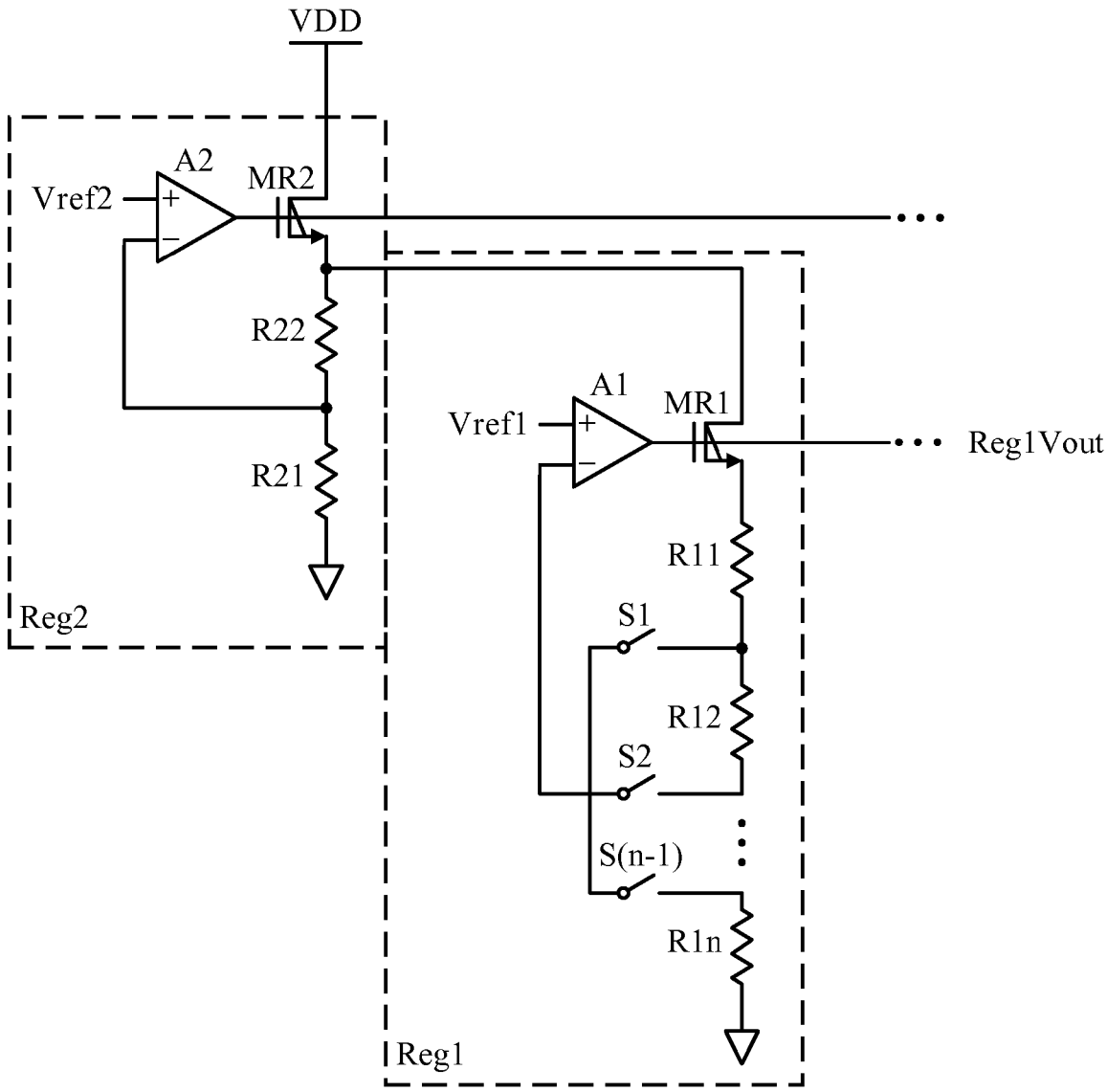
FIG. 6 depicts an embodiment wherein the resistance ratio of Reg1's feedback network is adjustable through switches S1 through S(n−1).

FIG. 6 depicts an embodiment wherein the resistance ratio of Reg1's feedback network is adjustable through switches S1 through S(n−1). By setting the resistance ratio of the feedback network, A1's output voltage Reg1Vout, and hence the regulated output voltage Vreg may be controlled. In particular, Reg1Vout may be expressed as Vref1*(1+Rbottom/Rtop), where Rbottom is the sum of R's below the turned on switch, and Rtop is the sum of R's above the turned on switch. In an embodiment (not shown), Reg2 may employ the same technique of adjustable switches as is shown in FIG. 6 for Reg1.

Figure 7:
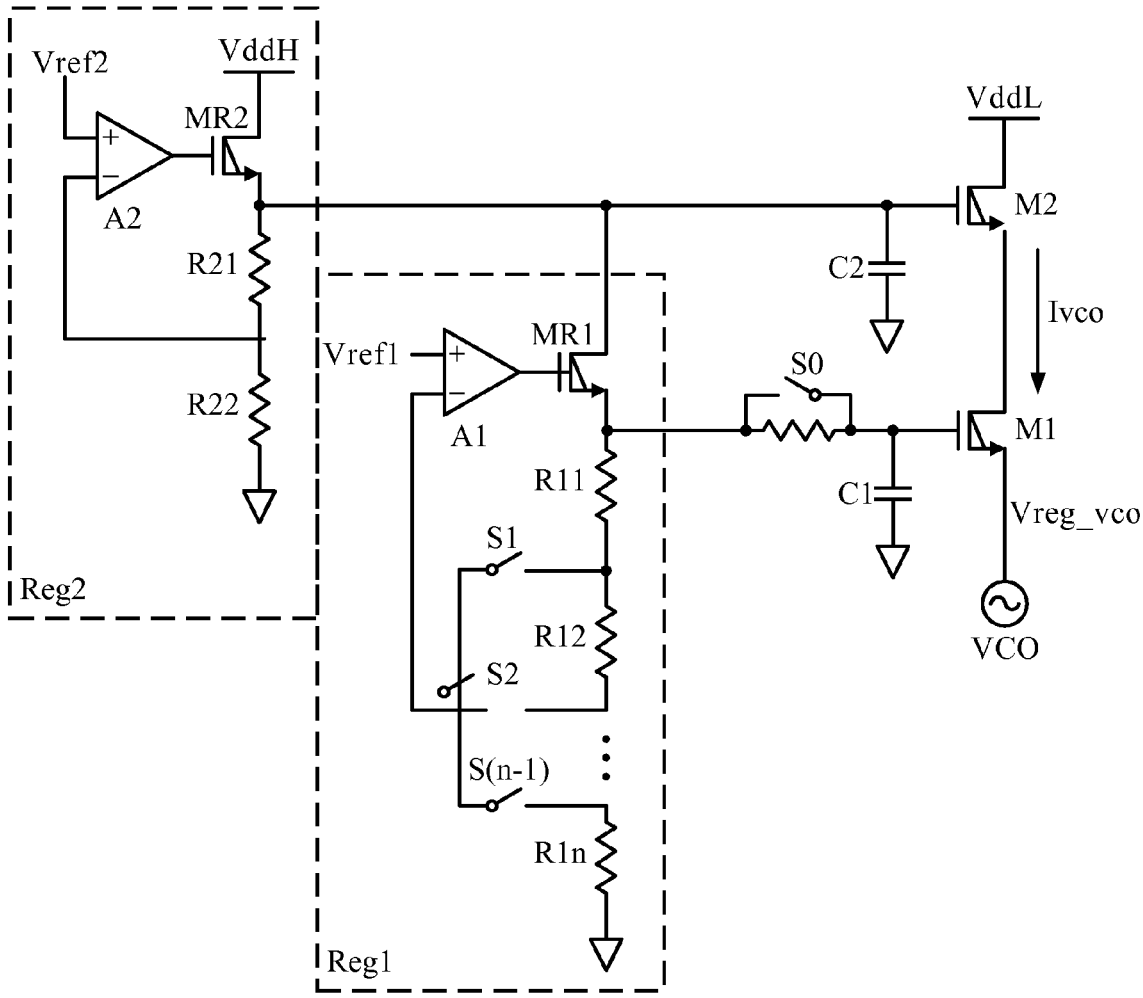
FIG. 7 depicts an embodiment integrating a number of the features described above.

FIG. 7 depicts an embodiment integrating a number of the features described above. The operation of the circuit shown will be clear to one of ordinary skill in the art in light of the disclosure above. In the embodiment shown, the regulated output Vreg_VCO is supplied to a voltage-controlled oscillator (VCO) circuit as a load.

Note that as there is no current flow between the internal regulator outputs and the gates of M2, M1, MR2, MR1 may be designed to be physically distant from the internal regulators, and may lie, for example, close to the load.

Based on the teachings described herein, it should be apparent that an aspect disclosed herein may be implemented independently of any other aspects and that two or more of these aspects may be combined in various ways. Aspects of the techniques described herein may be implemented in hardware, software, firmware, or any combination thereof. If implemented in hardware, the techniques may be realized using digital hardware, analog hardware or a combination thereof. If implemented in software, the techniques may be realized at least in part by a computer-program product that includes a computer readable medium on which one or more instructions or code is stored.

By way of example, and not limitation, such computer-readable media can comprise RAM, such as synchronous dynamic random access memory (SDRAM), read-only memory (ROM), non-volatile random access memory (NVRAM), ROM, electrically erasable programmable read-only memory (EEPROM), erasable programmable read-only memory (EPROM), FLASH memory, CD-ROM or other optical disk storage, magnetic disk storage or other magnetic storage devices, or any other tangible medium that can be used to carry or store desired program code in the form of instructions or data structures and that can be accessed by a computer.

The instructions or code associated with a computer-readable medium of the computer program product may be executed by a computer, e.g., by one or more processors, such as one or more digital signal processors (DSPs), general purpose microprocessors, ASICs, FPGAs, or other equivalent integrated or discrete logic circuitry.

In this specification and in the claims, it will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present.

A number of aspects and examples have been described. However, various modifications to these examples are possible, and the principles presented herein may be applied to other aspects as well. These and other aspects are within the scope of the following claims.

The invention claimed is:

1. An apparatus for generating a regulated output voltage from an unregulated voltage, the apparatus comprising:

a secondary source follower comprising a secondary native NMOS transistor, the secondary source follower having a drain, gate, and source voltage, the drain voltage coupled to the unregulated voltage;

a primary source follower comprising a primary native NMOS transistor, the primary source follower having a drain, gate, and source voltage, the drain voltage of the primary source follower coupled to the source voltage of the secondary source follower, the source voltage of the primary source follower being the regulated output voltage;

a secondary internal regulator comprising an amplifier and a feedback network, the feedback network comprising a secondary internal native NMOS transistor, the secondary internal regulator configured to regulate a gate-source voltage of the secondary internal native NMOS transistor, an output voltage of the secondary internal regulator comprising the gate or source voltage of the secondary internal native NMOS transistor, the output voltage of the secondary internal regulator coupled to the gate voltage of the secondary source follower; and a primary internal regulator comprising an amplifier and a feedback network, the feedback network comprising a primary internal native NMOS transistor, the primary internal regulator configured to regulate a gate-source voltage of the primary internal native NMOS transistor, an output voltage of the primary internal regulator comprising the gate or source voltage of the primary internal native NMOS transistor, the output voltage of the primary internal regulator coupled to the gate voltage of the primary source follower.

2. The apparatus of claim 1, further comprising a low-pass filter coupled to the gate voltage of the primary source follower.

3. The apparatus of claim 1, further comprising a primary capacitance coupled to the gate voltage of the primary source follower, and a secondary capacitance coupled to the gate voltage of the secondary source follower.

4. The apparatus of claim 3, further comprising a resistance coupled between the output voltage of the secondary internal regulator and the gate voltage of the secondary source follower.

5. The apparatus of claim 3, further comprising a resistance coupled between the output voltage of the primary internal regulator and the gate voltage of the primary source follower.

6. The apparatus of claim 5, at least one of the primary capacitance, the secondary capacitance, and the resistance being implemented as a MOSFET device.

7. The apparatus of claim 5, further comprising a switch for bypassing the resistance.

8. The apparatus of claim 1, the drain voltage of the secondary internal native NMOS transistor coupled to a first voltage source, the drain voltage of the secondary native NMOS transistor coupled to a second voltage source, the first voltage source having a higher voltage than the second voltage source.

9. The apparatus of claim 1, the feedback network of the primary internal regulator further comprising a resistive divider, the divided voltage of the resistive divider coupled to a negative terminal of the amplifier.

10. The apparatus of claim 9, the resistive divider comprising at least one switch for controlling the resistance division.

11. The apparatus of claim 1, the primary internal native NMOS transistor having dimensions matched to the primary native NMOS transistor, and the secondary internal regulator native NMOS transistor having dimensions matched to the secondary native NMOS transistor.

12. The apparatus of claim 1, the primary internal regulator native NMOS transistor or the secondary internal regulator native NMOS transistor having a first oxide thickness, and the primary native NMOS transistor or the secondary native NMOS transistor having a second oxide thickness, the first oxide thickness being greater than the second oxide thickness.

13. The apparatus of claim 1, the output voltage of the secondary internal regulator being the gate voltage of the secondary internal native NMOS transistor, and the output voltage of the primary internal regulator being the gate voltage of the primary internal native NMOS transistor.

14. The apparatus of claim 1, the output voltage of the secondary internal regulator being the source voltage of the secondary internal native NMOS transistor, and the output voltage of the primary internal regulator being the source voltage of the primary internal native NMOS transistor.

15. An apparatus for generating an output regulated voltage from an unregulated voltage, the apparatus comprising:

a secondary source follower comprising a secondary native NMOS transistor, the secondary source follower having a drain, gate, and source voltage, the drain voltage coupled to the unregulated voltage;

a primary source follower comprising a primary native NMOS transistor, the primary source follower having a drain, gate, and source voltage, the drain voltage of the primary source follower coupled to the source voltage of the secondary source follower, the source voltage of the primary source follower being the output regulated voltage;

means for generating a secondary internal regulated voltage coupled to the gate voltage of the secondary source follower; and means for generating a primary internal regulated voltage coupled to the gate voltage of the primary source follower.

16. A method for generating a regulated output voltage from an unregulated voltage, the method comprising:

regulating a gate-source voltage of a secondary internal native NMOS transistor;

providing the gate or source voltage of the secondary internal native NMOS transistor to the gate of a secondary source follower, the drain of the secondary source follower coupled to the unregulated voltage;

regulating a gate-source voltage of a primary internal native NMOS transistor, the drain of the primary internal native NMOS transistor coupled to the source of the secondary internal native NMOS transistor; and providing the gate or source voltage of the primary internal native NMOS transistor to the gate of a primary source follower, the drain of the primary source follower coupled to the source of the secondary source follower, the source voltage of the primary internal native NMOS transistor being the regulated output voltage.

17. The method of claim 16, the regulating the gate-source voltage of the primary internal native NMOS transistor comprising:

sensing a current flow through a first resistance, the current being a drain-source current of the primary internal native NMOS transistor; and increasing the gate voltage of the primary internal native NMOS transistor if the sensed current is lower than a reference value.

18. The method of claim 17, further comprising switching the value of the first resistance.

19. The method of claim 16, further comprising low-pass filtering the gate voltage of the primary source follower.

20. The method of claim 19, further comprising bypassing the low-pass filtering during a power-up phase using a switch.

21. The method of claim 16, further comprising coupling the drain of the secondary internal native NMOS transistor to a higher voltage than the unregulated voltage.

22. The method of claim 16, wherein:

providing the gate or source voltage of the secondary internal native NMOS transistor to the gate of the secondary source follower comprises coupling the gate voltage of the secondary internal native NMOS transistor to the gate of the secondary source follower; and providing the gate or source voltage of the primary internal native NMOS transistor to the gate of a primary source follower comprises coupling the gate voltage of the primary internal native NMOS transistor to the gate of the primary source follower.

23. The method of claim 16, wherein:

providing the gate or source voltage of the secondary internal native NMOS transistor to the gate of the secondary source follower comprises coupling the source voltage of the secondary internal native NMOS transistor to the gate of the secondary source follower; and providing the gate or source voltage of the primary internal native NMOS transistor to the gate of a primary source follower comprises coupling the source voltage of the primary internal native NMOS transistor to the gate of the primary source follower.

24. The apparatus of claim 22, wherein:

said means for providing the gate or source voltage of the secondary internal native NMOS transistor to the gate of the secondary source follower comprises means for coupling the gate voltage of the secondary internal native NMOS transistor to the gate of the secondary source follower; and said means for providing the gate or source voltage of the primary internal native NMOS transistor to the gate of a primary source follower comprises means for coupling the gate voltage of the primary internal native NMOS transistor to the gate of the primary source follower.

25. An apparatus for generating a regulated output voltage from an unregulated voltage, the apparatus comprising:

a source follower comprising a native NMOS transistor, the source follower having a drain, gate, and source voltage, the drain voltage coupled to the unregulated voltage, the source voltage of the source follower being the regulated output voltage; and an internal regulator comprising an amplifier and a feedback network, the feedback network comprising an internal native NMOS transistor, the internal regulator configured to regulate a gate-source voltage of the internal native NMOS transistor, the drain voltage of the internal native NMOS transistor coupled to a first voltage source, the drain voltage of the native NMOS transistor coupled to a second voltage source, the first voltage source having a higher voltage than the second voltage source, an output voltage of the internal regulator comprising the gate or source voltage of the internal native NMOS transistor, and the output voltage of the internal regulator coupled to the gate voltage of the source follower.

26. The apparatus of claim 25, further comprising a low-pass filter coupled to the gate voltage of the source follower.

27. The apparatus of claim 25, the output voltage of the internal regulator being the source voltage of the internal native NMOS transistor.

28. The apparatus of claim 25, the output voltage of the internal regulator being the gate voltage of the internal native NMOS transistor.

29. An apparatus generating a regulated output voltage from an unregulated voltage, the apparatus comprising:

means for regulating a gate-source voltage of a secondary internal native NMOS transistor;

means for providing the gate or source voltage of the secondary internal native NMOS transistor to the gate of a secondary source follower, the drain of the secondary source follower coupled to the unregulated voltage;

means for regulating a gate-source voltage of a primary internal native NMOS transistor, the drain of the primary internal native NMOS transistor coupled to the source of the secondary internal native NMOS transistor; and means for providing the gate or source voltage of the primary internal native NMOS transistor to the gate of a primary source follower, the drain of the primary source follower coupled to the source of the secondary source follower, the source voltage of the primary internal native NMOS transistor being the regulated output voltage.

30. The apparatus of claim 29, wherein the means for regulating the gate-source voltage of the primary internal native NMOS transistor further comprising:

means for sensing a current flow through a first resistance, the current being a drain-source current of the primary internal native NMOS transistor; and means for increasing the gate voltage of the primary internal native NMOS transistor if the sensed current is lower than a reference value.

31. The apparatus of claim 30, further comprising means for switching the value of the first resistance.

32. The apparatus of claim 29, further comprising means for low-pass filtering the gate voltage of the primary source follower.

33. The apparatus of claim 32, further comprising means for bypassing the means for low-pass filtering during a power-up phase.

34. The apparatus of claim 29, further comprising means for coupling the drain of the secondary internal native NMOS transistor to a higher voltage than the unregulated voltage.

35. The apparatus of claim 29, wherein:

said means for providing the gate or source voltage of the secondary internal native NMOS transistor to the gate of the secondary source follower comprises means for coupling the source voltage of the secondary internal native NMOS transistor to the gate of the secondary source follower; and said mean for providing the gate or source voltage of the primary internal native NMOS transistor to the gate of a primary source follower comprises means for coupling the source voltage of the primary internal native NMOS transistor to the gate of the primary source follower.

36. A computer program product for generating a regulated output voltage from an unregulated voltage, the computer program product comprising:

a computer-readable medium having instructions stored thereon, the instructions comprising:

instructions for regulating a gate-source voltage of a secondary internal native NMOS transistor;

instructions for providing the gate or source voltage of the secondary internal native NMOS transistor to the gate of a secondary source follower, the drain of the secondary source follower coupled to the unregulated voltage;

instructions for regulating a gate-source voltage of a primary internal native NMOS transistor, the drain of the primary internal native NMOS transistor coupled to the source of the secondary internal native NMOS transistor; and instructions for providing the gate or source voltage of the primary internal native NMOS transistor to the gate of a primary source follower, the drain of the primary source follower coupled to the source of the secondary source follower, the source voltage of the primary internal native NMOS transistor being the regulated output voltage.

37. The computer program product of claim 36, wherein the computer-readable medium has instructions stored thereon further comprising:

instructions for sensing a current flow through a first resistance, the current being a drain-source current of the primary internal native NMOS transistor; and instructions for increasing the gate voltage of the primary internal native NMOS transistor if the sensed current is lower than a reference value.

38. The computer program product of claim 37 wherein the computer-readable medium has instructions stored thereon further comprising instructions for switching the value of the first resistance.

39. The computer program product of claim 36, wherein the computer-readable medium has instructions stored thereon further comprising instructions for low-pass filtering the gate voltage of the primary source follower.

40. The computer program product of claim 39, wherein the computer-readable medium has instructions stored thereon further comprising instructions for bypassing the low-pass filter during a power-up phase.

41. The computer program product of claim 36, wherein the computer-readable medium has instructions stored thereon further comprising instructions for coupling the drain of the secondary internal native NMOS transistor to a higher voltage than the unregulated voltage.

42. The computer program product of claim 36, wherein:

the instructions for providing the gate or source voltage of the secondary internal native NMOS transistor to the gate of the secondary source follower comprises instructions for coupling the gate voltage of the secondary internal native NMOS transistor to the gate of the secondary source follower; and the instructions for providing the gate or source voltage of the primary internal native NMOS transistor to the gate of a primary source follower comprises instructions for coupling the gate voltage of the primary internal native NMOS transistor to the gate of the primary source follower.

43. The computer program product of claim 36, wherein:

the instructions for providing the gate or source voltage of the secondary internal native NMOS transistor to the gate of the secondary source follower comprises instructions for coupling the source voltage of the secondary internal native NMOS transistor to the gate of the secondary source follower; and the instructions for providing the gate or source voltage of the primary internal native NMOS transistor to the gate of a primary source follower comprises instructions for coupling the source voltage of the primary internal native NMOS transistor to the gate of the primary source follower.

* * * * *